US005134813A

United States Patent [19]

Betts

[11] Patent Number: 5,134,813

[45] Date of Patent: Aug. 4, 1992

[54] STANDARDIZED AUXILIARY ENCLOSURE

[75] Inventor: Daniel L. Betts, Triangle, Va.

[73] Assignee: Deck-Mate Builders, Inc., Lorton, Va.

[21] Appl. No.: 527,301

[22] Filed: May 23, 1990

[51] Int. Cl.[5] ..... E04B 7/02

[52] U.S. Cl. ..... 52/90; 52/463

[58] Field of Search ..... 52/90, 86, 222, 14, 52/15

[56] References Cited

U.S. PATENT DOCUMENTS

| | | | |
|---|---|---|---|
| 3,844,087 | 10/1974 | Schultz | 52/463 |
| 4,194,325 | 3/1980 | Chalpin | 52/14 |
| 4,583,333 | 4/1986 | Minter | 52/90 |
| 4,884,376 | 12/1989 | DeBlock | 52/463 |
| 4,899,507 | 2/1990 | Mairlot | 52/222 |
| 4,918,882 | 4/1990 | Funk | 52/86 |
| 5,007,215 | 4/1991 | Minter | 52/90 |

FOREIGN PATENT DOCUMENTS

| | | | |
|---|---|---|---|
| 2023271 | 7/1971 | Fed. Rep. of Germany | 52/14 |

*Primary Examiner*—David A. Scherbel
*Assistant Examiner*—Creighton Smith
*Attorney, Agent, or Firm*—Leydig, Voit & Mayer

[57] ABSTRACT

A standardized auxiliary enclosure structure adapted for addition to a deck or porch and methods of construction including reinforced roof support posts, pocket beams, round robins, and curved polyacrylate panels.

16 Claims, 5 Drawing Sheets

STANDARDIZED AUXILIARY ENCLOSURE

TECHNICAL FIELD

This invention relates to construction of auxiliary enclosures particularly adapted for retrofitting to an existing deck or for a newly constructed deck.

BACKGROUND OF THE INVENTION

To enhance the property value and add additional usable recreational space at a minimum cost, many homeowners have turned to the addition of a deck to their residence. Likewise, screened porches and sun rooms are also popular additions to residences to protect the users from insects, ambient weather conditions, etc, and to promote quiet enjoyment of the enclosure. Many enclosures of these types are retrofitted to existing structures and are either pre-fabricated or contracted out on an individualized construction basis, i.e. "stick built". While pre-fabricated enclosures are readily available, they are neither aesthetically nor structurally compatible with existing decking structures. Conversely, "stick built" structures can be designed and configured to be compatible with decking structures. However, they entail a contractor going to the site and constructing the deck covering, screen porch or sun room, generally in a non-standardized manner based on the particular configurations and dimensions unique to that site. Consequently, tolerances in crafting will differ not only from site to site but also from worker to worker. Ofeen many days if not weeks of labor are required to complete assembly of a "stick built" enclosure and the nature of the site as well as the character of the construction crew will be reflected in the finished structure. Hence, the structural integrity and strength of such enclosures are subject to wide variation and defy elegant, standardized, and uniform construction.

One further consideration, critical in the final evaluation of decking enclosures, is aesthetics. It is crucial that any enclosure must not only be functionally sound but also must satisfy the tastes of its owner. If the structure is unsatisfactory as an architectural compliment to the attached edifice, the landscaping or the owner's tastes, the enclosure may very well detract from rather than enhance the enjoyment of the property.

SUMMARY OF THE INVENTION

Therefore, it is an object of the present invention to provide a standardized deck or porch enclosure structure.

It is another object of this invention to provide an structure that lends itself to factory pre-sizing and partial modularization of enclosure components.

Another object of this invention is to provide an attractive, utilitarian enclosure for a deck or a porch to maximize user enjoyment.

Still another object of this invention is to provide an enclosure ensuring drainage of ambient precipitation away from the enclosure.

Yet another object of this invention is to provide a structure that promotes air circulation within the enclosure.

These and other objects are satisfied by an enclosure for an exterior recreational space where the recreational space is defined by an exteriorly exposed floor, the enclosure comprising, side walls, and a ceiling dimensioned to conform to the floor and enclose the recreational space. The ceiling includes a plurality of spaced elongated beams, each beam defining a channel containing a first element of a cooperating elongated securing member, lateral cross support units dimensioned to extend between two adjacent elongated beams, said lateral cross support units being secured to the two adjacent beams, roof panels dimensioned to cover said lateral cross support units and extend between said adjacent beams, a second element of said cooperating securing member, said second element being substantially coextensive with said first element and dimensioned to overlie the edges of said roof panels, and means for affixing said first element to said second element to form said cooperating securing member, said cooperating securing member positionally stabilizing said roof panels with respect to said beams and cross support units.

Other objects of this invention are satisfied by a roof/ceiling for an enclosure structure comprising a plurality of spaced elongated beams, each beam defining a channel containing a first element of a cooperating elongated securing member, lateral cross support units dimensioned to extend between two adjacent elongated beams, said lateral cross support units being secured to the two adjacent beams, roof panels dimensioned to cover said lateral cross support units and extend between said adjacent beams, a second element of said cooperating securing member, said second element being substantially coextensive with said first element and dimensioned to overlie the edges of said roof panels, and means for affixing said first element to said second element to form said cooperating securing member, said cooperating securing member positionally stabilizing said roof panels with respect to said beams and cross support units.

Given the following enabling description of the drawings, the construction, structure and scope of the invention should become evident to the person of ordinary skill in the art.

DETAILED DESCRIPTION OF THE INVENTION

Figure 1:
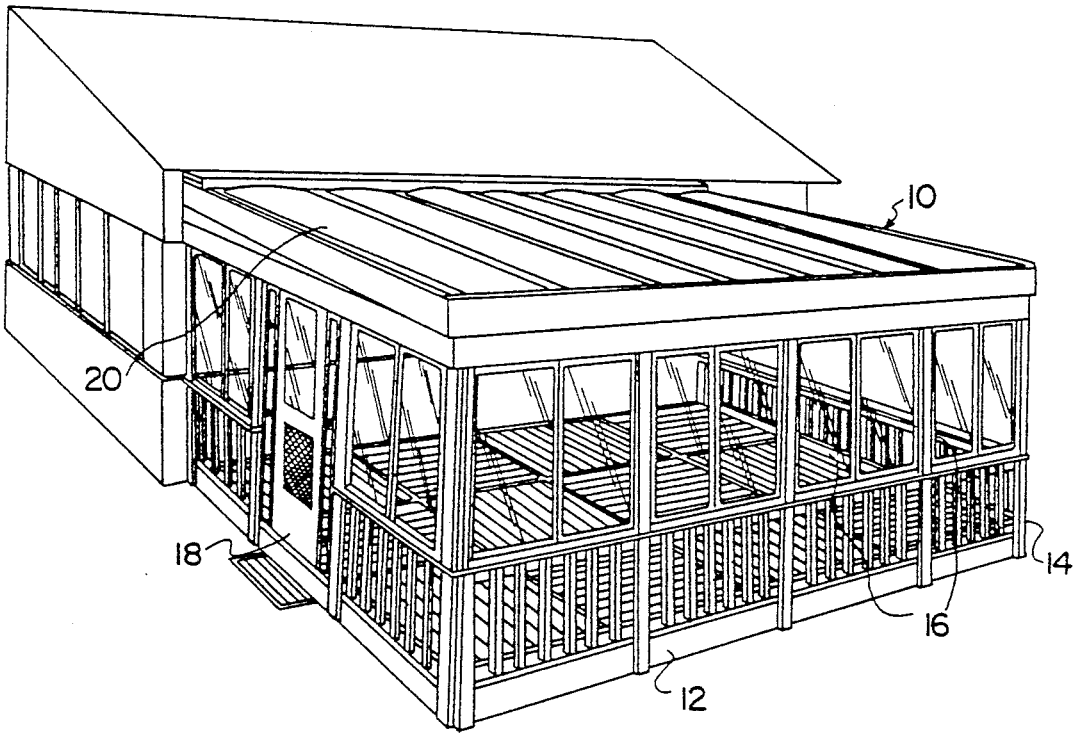
FIG. 1 is a perspective view of an enclosure constructed in accordance with the invention.

FIG. 1 illustrates an auxiliary deck enclosure 10 produced in accordance with this invention is depicted. Auxiliary enclosure 10 overlies and encloses the area, generally abutting an existing structure (house), defined by existing porch or deck 12 and contemplates incorporating existing railing 14. Enclosure 10 includes polyacrylate and/or screened sections 16 which may extend either from the deck floor or the top of railing 14. Door 18 is also provided to facilitate use of the enclosure 10. The exterior surface of roof/ceiling 20 features a series of parallel, bowed, transparent polyacrylate sections (Compare with checkerboard interior ceiling surface of FIG. 18). The roof/ceiling 20 conforms with BOCA building code standards with a minimum roof live load of 30 psi and a dead load of 10 psi.

Before turning to the detailed series of figures illustrating the construction methods for and structures incorporated in the auxiliary enclosure 10, the standardization concept associated with the instant invention complements that of other structures such as the standardized, modular deck invention described and claimed in U.S. Pat. No. 4,622,792 which is incorporated by reference herein. It should be noted that where necessary, deck or porch footers may require reinforcement prior to enclosure construction to satisfy building code requirements. Since the dimensions of each constructed enclosure 10 will be dictated by existing conditions and the purchaser, the enclosure cannot be prefabricated entirely in a factory. However, the components can be pre-sized and cut at a factory from site measurements and certain components modularized. Therefore, variations in tolerances are substantially avoided.

Figure 2:
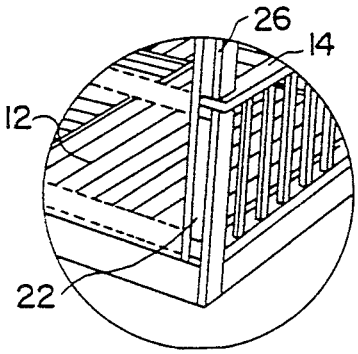
FIG. 2 is a perspective schematic the T-jack and T-plate corner post structure in the region of the porch railing.
Figure 3:
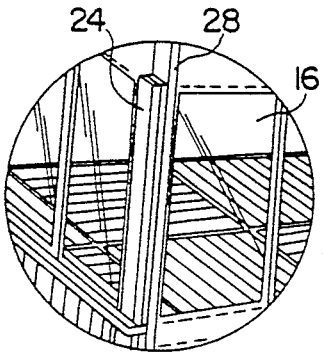
FIG. 3 is a view of the upper portion of the notched T-jack.
Figure 4:
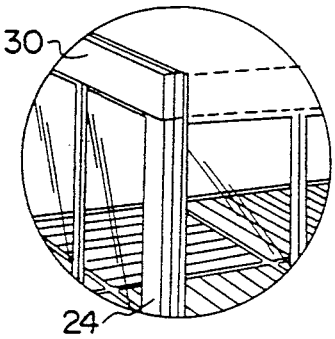
FIG. 4 is a similar view of the header beam and T-jack structure.

FIG. 2 represents the construction of supporting post 26 employing appropriately sized T-jacks 22 formed from three 2×4 boards which have been nailed together and have been pre-cut to accommodate railing 14. Post 26, as is the case with the other wood components described below, are formed from exterior exposure/pressure treated Southern Pine possessing a maximum moisture content of about 15%. Such pressure treated wood survives stresses of $f_b=1850$ psi, $f_v=95$ psi, $f_c=660$ psi, and $E=1.9\times10^6$ psi Reinforced support post 26 is incorporated in the outside corners of the existing deck structure and is constructed employing T-jack 22 and T-plates 24 (depicted in FIG. 3) extend a selected length corresponding to the desired exterior wall height. Additional support posts should be incorporated, at least, every 8 lineal feet per side, but preferably every 4 feet, to insure adequate structural strength. As is apparent in FIG. 3, posts 26 include notch 28 at its upper end to receive double header beam 30 (which itself is notched) illustrated in FIG. 4. The notch 28 corresponds to the height and width of the double header beam 30 which is generally formed from two nailed 2×10 boards. Beam 30 is positioned on notch 28 and screwed or lagged to post 26 and at the other end, is secured with a joist hanger and lagged to the permanent existing structure (house). FIGS. 1–4 also depict screen or plexiglass units 16 which may be installed permanently or provided with means for convertibility, i.e. removal and replacement. Since these devices and techniques are well known to the person having ordinary skill in the art, i.e. latches, sliding bolts, etc., the particular structure selected to provide for the convertibility will not be elaborated on here.

Figure 5:
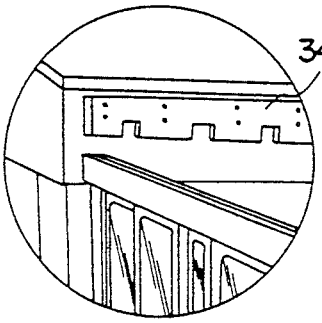
FIG. 5 illustrates the notched roof plate secured to the permanent structure from which the enclosure extends.
Figure 6:
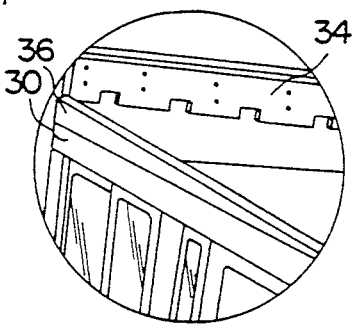
FIG. 6 illustrates the position of the canting strips on the header beams.
Figure 7:
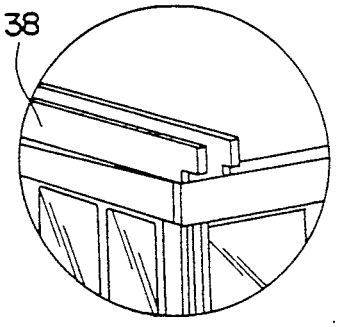
FIG. 7 is a perspective view of a pocket beam positioned on the canting strip.
Figure 8:
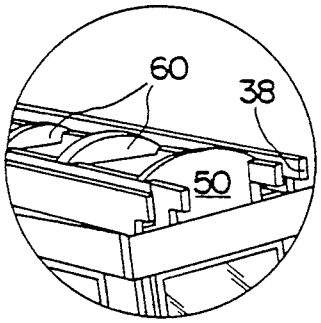
FIG. 8 illustrates the eve robin and round robin structures bridging the gaps between two spaced pocket beams.

Turning now to FIGS. 5 through 15, they describe the roof/ceiling 20 framing details. FIG. 5 illustrates notched roof plate 34 where the notches are regularly spaced and fix the location of placement of the later described pocket beams. Roof plate 34 is lagged under the eaves of the existing structure and at an appropriate height to permit installation of the canting strips, pocket beams and splash plates described hereinbelow. Canting strips 36, illustrated in FIG. 6, are nailed or otherwise attached to the top of the header beam to provide an appropriately angled declining slope from the roof plate to the supporting posts 26. The angle of the slope will generally range between 4° and 15° but preferably with a three inch strip, about 10° in order to provide for sufficient gravity flow of precipitation away from the existing structure.

Pocket beams 38, a critical component of this invention, are notched at each end to permit one end to be lagged into roof plate 34 (see FIG. 7) and the other secured to the below-described gutter. The two pocket beams 38, positioned along the enclosure side edges to overlie header beams 30, are set on canting strips 36. Furthermore, pocket beams 38 feature regularly spaced vertical notches for slidably receiving the edges of and retaining the below-described round robins and eve robins.

Figure 16:
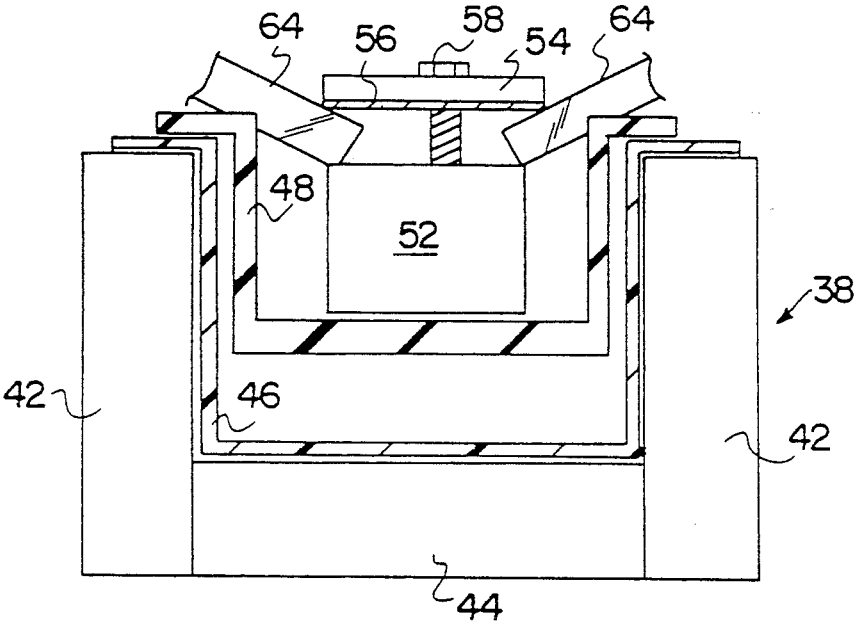
FIG. 16 is a cross-sectional view of the pocket beam structure.

Pocket beams 38 are depicted in greater detail in FIG. 16. Referring now to that figure, pocket beam 38 includes a wooden U-shaped channel defined by base plate 44 and upstanding spaced legs 40 and 42. The channel is lined with a vinyl or metal, water impervious liner 46 to promote uninterrupted, continuous precipitation flow within the channel. Liner 46 is secured to the pocket beam by any conventional method which does not adversely affect the integrity of the flow path to the gutter end of beam 38. At regularly spaced intervals along the length of pocket beam 38 metal brackets 48 are installed which in turn support and secure channel batten board element 52. Brackets 48 are staggered relative to the vertical notches along the direction of elongation of beams 38. Channel batten board element 52 is substantially co-extensive with pocket beam 38 in its direction of elongation. Brackets 48 are secured to legs 40 and 42 of pocket beam 38 by screwing, nailing, riveting or the like through liner 46 in a manner so as not to adversely affect the integrity thereof. It has been found that channel batten board element 52 should have cross-sectional dimensions of at least 1×2 or 2×2. This is necessary since element 52 secures batten board 54, on the bottom side of which fabric layer 56 composed of an appropriate durable, environmentally resistant material such a synthetic polymeric felt is attached.

Figure 17:
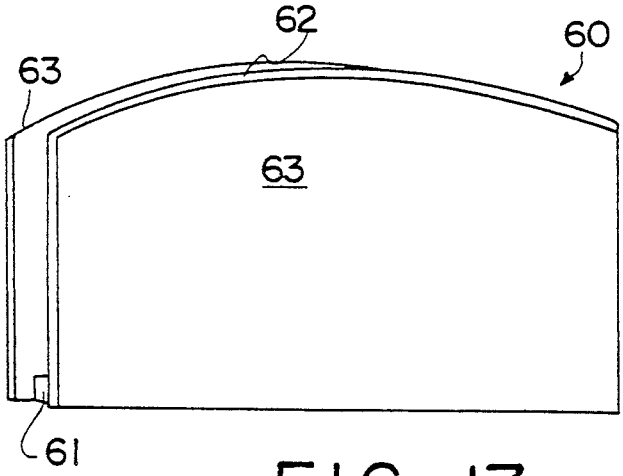
FIG. 17 schematically depicts a round robin structure.

Returning now to FIG. 8, round robin structure 60 and eve robin 50. Both the eve and round robins are recessed into and toe-nailed into the vertical notches of pocket beams 38 at the regularly spaced intervals. Not only do the regularly spaced eve robins 50 and round robins 60 establish uniform lateral reinforcement between the pocket beams 38, but also provide an attractive checked ceiling pattern. Referring briefly to a more detailed depiction of a round robin, in FIG. 17 the round robin structure includes two spaced plates 63, and a 1×6 cross-board 61 formed from solid board or exterior grade plywood. Cross-board 61 preferably is slightly shorter than plates 63 are wide, to accommodate the recessing and to abut legs 40 and 42. A felt/fabric layer 62 corresponding to that of covering 56 referred to above, is provided on the arcuate upper surface. Eve robins 50, in contrast to round robins 60, possess a mushroom shape and are formed from a 2×10 board. A depicted in FIGS. 8 and 9 eve robins 50 include notches, corresponding largely to the width of pocket beam legs 40 and 42, which permits an eve robin to rest on leg 40 of one pocket beam and 42 of the adjacent, spaced pocket beam 38. Both the eve and round robins are dimensioned so that when properly installed, they provide standardized lateral, spaced support between adjacent pocket beams 38.

Figure 9:
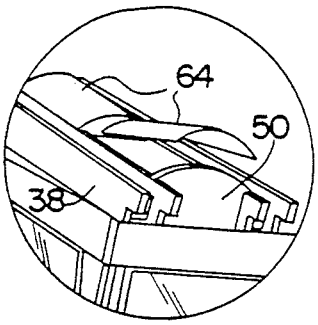
FIG. 9 illustrates the positioning of polyacrylate strips over the round robins and the pocket beams.
Figure 10:
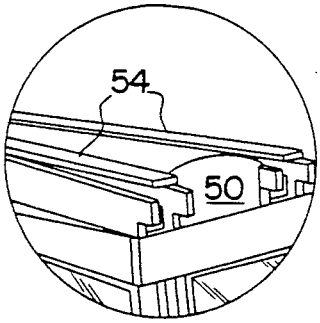
FIG. 10 illustrates placement of polyacrylate panels over the round robins with batten boards.
Figure 11:
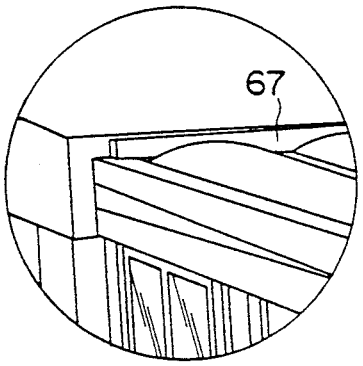
FIG. 11 is a view of the positioning of the splash plate over the roof plate and against the permanent structure from which the enclosure is attached.

Turning now FIG. 9, polyacrylate (Plexiglass®) sheeting, pre-bent or flexible, is installed either in the form of discreet multiple units or preferably, a single length corresponding to the length of pocket beams 38. The polyacrylate sheeting can be clear or colored (e.g. bronze) and should be of sufficient thickness to satisfy code standards while being sufficiently thin to facilitate appropriate clamping installation on the round and eve robins and between pocket beams 38.

Installation of the polyacrylate sheets is accomplished by use of batten boards 54 illustrated in FIG. 10 again in FIG. 16. Batten boards 54 are tightened by screw 58 into batten board channel element 52 whereby the edges of plexiglass sheets 64 are compressed between the bottom of batten board 54 and the round or eve robins. Nails, rivets, bolts and the like can be substituted for screws 58. It is important to recognize, however, that there is no need to insure a water tight seal between sheet 64 and its corresponding batten board. Indeed, overtightening to clamp sheet 64, which prevents translation relative to round robin 60 during expansion and contraction cycles, is discouraged. Any precipitation penetrating the junction will flow harmlessly into the channel of pocket beam 38 and then, as will be revealed below, into a box gutter.

The textile (felt) strips 62, preferably composed of synthetic, long-lived fibers, which are employed on those elements in contact with polyacrylate sheets 64, permit substantially noiseless expansion and contraction of the polyacrylate sheets when exposed to alternating sun and cloud conditions. It is well known that polyacrylate sheeting has a large thermal coefficient of expansion which therefore causes significant expansion and contraction during heating and cooling cycles. The felt/fabric is provided to eliminate the cracking or popping noises that accompany abutting sheeting and wood structures. Thus, the felt/fabric facilitates silent expansion and contraction.

Figure 13:
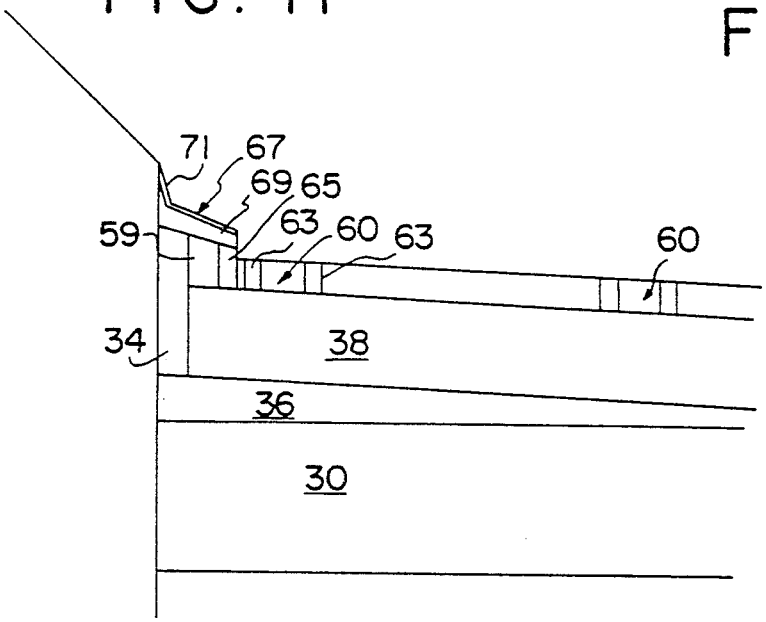
FIG. 13 is a schematic cross-sectional view of the vented flash box.

Once polyacrylate sheeting is installed, vented flash box 67 including splash plate 65, 1×6 cap 69 and sealed aluminum coil stock covering 71, is lagged into the permanent structure and secured to roof plate 34 to prevent precipitation penetration at the junction of the roof/ceiling 20 and the contiguous permanent structure (See FIG. 13). Vented flash box 67 promotes air circulation in the enclosure from chamber 59. Air circulation considerations are significant in warmer weather for user comfort and structural integrity. Since hot air rises, that in the interior of the enclosure will tend to flow along the slope of the ceiling toward roof plate 34 and would be trapped is not vented. Trapped warmed air could lead to unequal expansion of the enclosure components and make for an uncomfortable environment. The junction of roof/ceiling 20 and the permanent structure is provided with vented box 67, both for reasons of appearance and to facilitate air circulation into the pocket beams 38. Therefore, when the warmer air reaches the junction (at the roof plate), the air can escape from the enclosure through a gap provided behind the splash guard.

Figure 12:
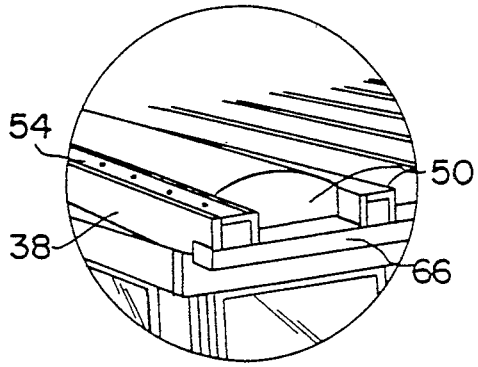
FIG. 12 depicts the placement of the front box gutter.

Following installation of the flash box 67, front box gutter 66 is installed at the opposite ends of pocket beams 38 (FIG. 12). Front box gutter 66 is lined with a liner similar to that of pocket beam liner 46 and is sized to fit uniformly in the notch provided in the exposed end of pocket beams 38. Therefore, precipitation, which penetrates into pocket beams 38, will discharge into the front box gutter. The bottom piece of box gutter 66 should be canted at an angle to provide for gravity assisted flow to one end of the box gutter where an appropriate drain pipe or opening (not illustrated) is provided to remove the precipitation from enclosure 10.

Figure 14:
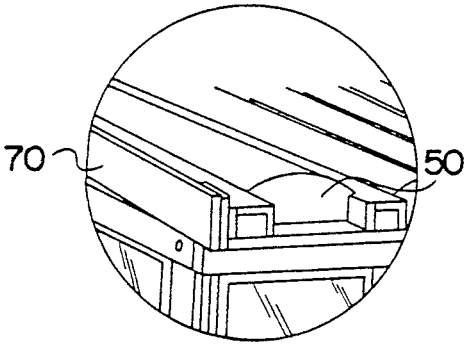
FIG. 14 depicts the installation of the fascia side board.
Figure 15:
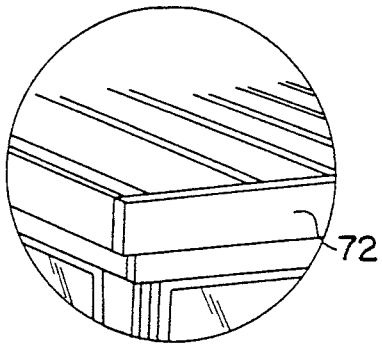
FIG. 15 illustrates the installation of the fascia front board.

After box gutter 66 is installed, 2×4 fascia side supports are nailed to the sides of the outer pocket beams 38 and canting strips 36, thus forming the outer edges of the enclosure ceiling. Side fascia board 70 is then nailed into the side supports as represented in FIG. 14. The final installation involves fascia front board 72 which is installed over the ends of pocket beams 38 and front box gutter 66.

Figure 18:
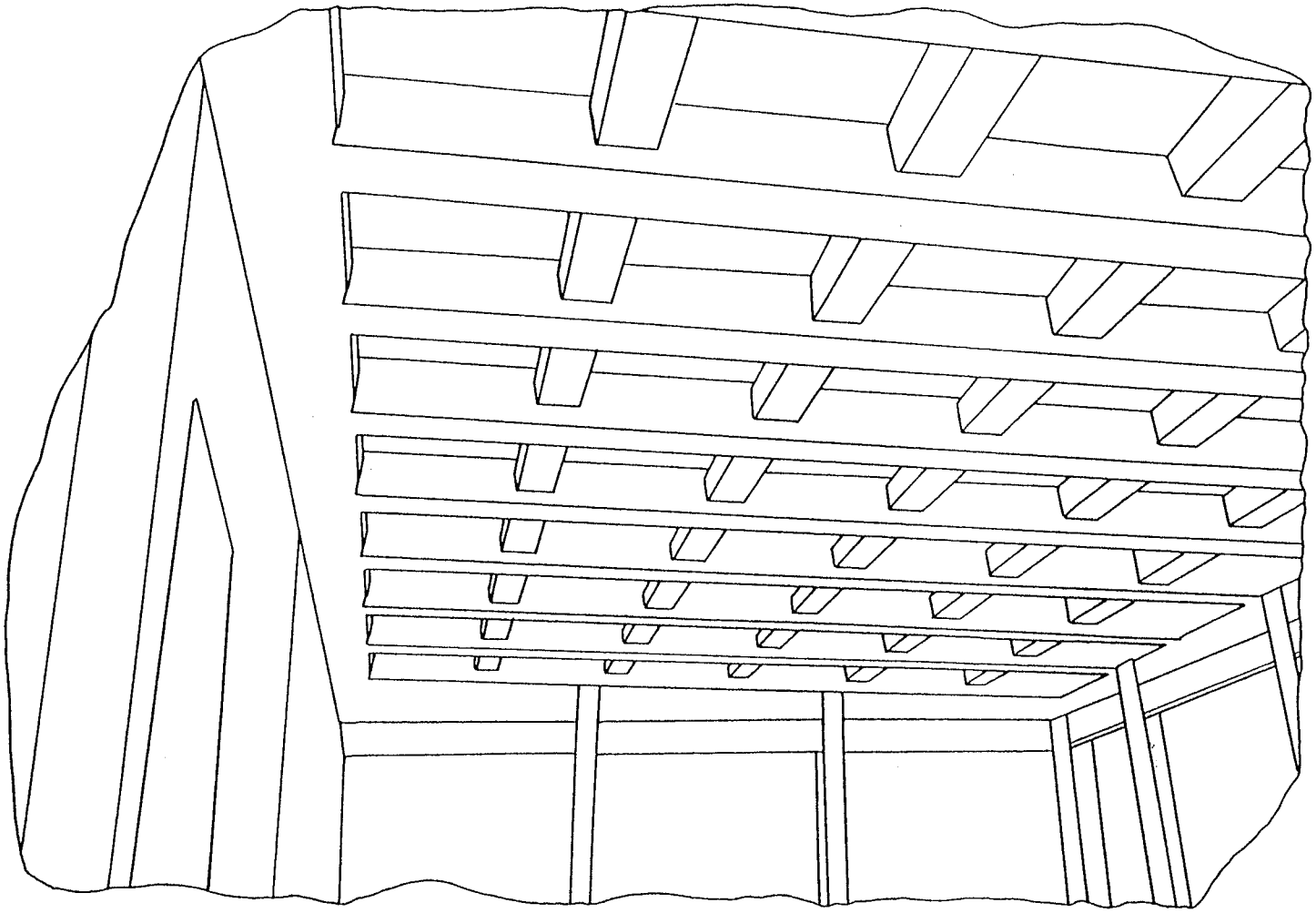
FIG. 18 is a representation of the ceiling in accordance with the illustrated embodiment of this invention.

Referring now to FIG. 18, the resulting ceiling structure from the above described construction is depicted. It provides a checkerboard pattern with clear panels permitting sunlight to penetrate into the enclosure.

As indicated above, it is preferred that enclosure 10 include polyacrylate windows which can extend either from the ceiling to the top of the rail or extend to the deck. However, where it is preferred by the resident owner, screen units corresponding in size to the polyacrylate panels, can be substituted. In respect to the use of polyacrylate, any appropriate sheet-like material can be employed. A substitute material can be thick glass, polycarbonate (Lexan), or other materials possessing structural and aesthetically desirable characteristics. The material sheets should permit light passage, i.e. transparent, translucent, frosted, etc.), should be somewhat scratch resistent, and should be environmentally stable in ambient conditions as well as acid insoluble (antiacid rain).

Given the foregoing, many variations, combinations and modifications of the instant invention should now be readily apparent to the person of ordinary skill in the art and, consequently, are intended to fall within the spirit and scope of the invention defined by the following claims.

I claim:

1. An enclosure for an exterior recreational space where the recreational space is defined by an exteriorly exposed floor, comprising:

side walls, and a ceiling dimensioned to conform to the floor and enclose the reactional space, said ceiling including a plurality of spaced elongated beams, each beam defining a water channel containing a first element of a cooperating elongated securing member, a plurality of substantially equally spaced lateral cross support units dimensioned to extend between two adjacent elongated beams, said lateral cross support units being secured to the two adjacent beams, roof panels dimensioned to cover said lateral cross support units and extend between said adjacent beams, a second element of said cooperating securing member, said second element being substantially coextensive with said first element and dimensioned to overlie the edges of said roof panels, and means for affixing said first element to said second element to form said cooperating securing member, said cooperating securing member positionally stabilizing said roof panels with respect to said beams and cross support units.

2. An enclosure according to claim 1 where the roof is canted to define upper and lower edges and further comprising a vented flash box at the upper edge of the canted roof and a gutter in fluid communication with said channel positioned along the lower edge.

3. An enclosure according to claim 1 where the side walls include transparent panels and a door.

4. An enclosure according to claim 3 where the panels are formed from framed clear acrylic sheets.

5. An enclosure according to claim 1 where the side walls and ceiling are supported by reinforced, triple beam, notched, supports.

6. An enclosure for an exterior recreational space where the recreational space is defined by an exteriorly exposed floor, comprising:

side walls, and a ceiling dimensioned to conform to the floor and enclose the recreational space, said ceiling including a plurality of spaced elongated beams, each beam defining a channel containing a first element of a cooperating elongated securing member, lateral cross support units dimensioned to extend between two adjacent elongated beams, said lateral cross support units being secured to the two adjacent beams, where the lateral cross support units are round robins, roof panels dimensioned to cover said lateral cross support units and extend between said adjacent beams, where the roof panels are transparent, bronze, polyacrylate sheets, a second element of said cooperating securing member, said second element being substantially coextensive with said first element and dimensioned to overlie the edges of said roof panels, and means for affixing said first element to said second element to form said cooperating securing member, said cooperating securing member positionally stabilizing said roof panels with respect to said beams and cross support units.

7. An enclosure according to claim 6 where the roof is canted to define upper and lower edges and further comprising a vented flash box at the upper edge of the canted roof and a gutter in fluid communication with said channel positioned along the lower edge.

8. A roof/ceiling for an enclosure structure, comprising:

a plurality of spaced elongated beams, each beam defining a water channel containing a first element of a cooperating elongated securing member, a plurality of substantially equally spaced lateral cross support units dimensioned to extend between two adjacent elongated beams, said lateral cross support units being secured to the two adjacent beams, roof panels dimensioned to cover said lateral cross support units and extend between said adjacent beams, a second element of said cooperating securing member, said second element being substantially coextensive with said first element and dimensioned to overlie the edges of side roof panels, and means for affixing said first element to said second element to form said cooperating securing member, said cooperating securing member positionally stabilizing said roof panels with respect to said beams and cross support units.

9. A roof/ceiling according to claim 8 where the channel is lined with a water impervious lining.

10. A roof/ceiling according to claim 8 further including means for canting the elongated beams to promote precipitation drainage to one edge of the roof/ceiling and a drainage gutter disposed along the one edge.

11. A roof/ceiling according to claim 8 where the roof is canted to define upper and lower edges and further comprising a vented flash box at the upper edge of the canted roof and a gutter in fluid communication with said channel positioned along the lower edge.

12. A roof/ceiling for an enclosure structure, comprising:

a plurality of spaced elongated beams, each beam defining a channel containing a first element of a cooperating elongated securing member, lateral cross support units dimensioned to extend between two adjacent elongated beams, said lateral cross support units being secured to the two adjacent beams, a textile cloth layer on the upper surfaces of the lateral supports and the cooperating securing member, roof panels dimensioned to cover said lateral cross support units and extend between said adjacent beams, a second element of said cooperating securing member, said second element being substantially coextensive with said first element and dimensioned to overlie the edges of said roof panels, and means for affixing said first element to said second element to form said cooperating securing member, said cooperating securing member positionally stabilizing said roof panels with respect to said beams and cross support units.

13. A roof/ceiling according to claim 12 where the lateral cross support units are round robins with an arcuate upper surface.

14. A roof/ceiling according to claim 13 where the roof panels are transparent acrylic/plexiglass.

15. A roof/ceiling according to claim 14 where the elongated beams and cross later support units define a uniform checkerboard pattern on the underside of the roof/ceiling.

16. An enclosure for an exterior recreational space where the recreational space is defined by an exteriorly exposed floor, comprising:

side walls, and a ceiling dimensioned to conform to the floor and enclose the recreational space, said ceiling including a plurality of spaced elongated beams, each beam defining a channel containing a first element of a cooperating elongated securing member, lateral cross support units dimensioned to extend between two adjacent elongated beams, said lateral cross support units being secured to the two adjacent beams, where the lateral cross support units are round robins, roof panels dimensioned to cover said lateral cross support units and extend between said adjacent beams, a second element of said cooperating securing member, said second element being substantially coextensive with said first element and dimensioned to overlie the edges of said roof panels, and means for affixing said first element to said second element to form said cooperating securing member, said cooperating securing member positionally stabilizing said roof panels with respect to said beams and cross support units.

* * * * *

UNITED STATES PATENT AND TRADEMARK OFFICE

CERTIFICATE OF CORRECTION

PATENT NO. : 5,134,813

DATED : August 4, 1992

INVENTOR(S) : Daniel L. Betts

It is certified that error appears in the above-identified patent and that said Letters Patent is hereby corrected as shown below:

Claim 15, column 8, line 59, change "later" to --lateral--.

Signed and Sealed this

Seventh Day of September, 1993

Bruce Lehman

*Attest:*

BRUCE LEHMAN

*Attesting Officer*

*Commissioner of Patents and Trademarks*